US005990064A

United States Patent [19]

Wierenga et al.

[11] Patent Number: 5,990,064

[45] **Date of Patent: *Nov. 23, 1999**

[54] COMPOSITIONS AND METHODS FOR CLEANING HARD SURFACES USING PROTONATED AMINES AND AMINE OXIDE SURFACTANTS

[75] Inventors: Thomas James Wierenga, Cincinnati; Bruce Barger, West Chester, both of Ohio

[73] Assignee: The Procter & Gamble Company, Cincinnati, Ohio

[ * ] Notice: This patent is subject to a terminal disclaimer.

[21] Appl. No.: 08/781,316

[22] Filed: Jan. 9, 1997

Related U.S. Application Data

[63] Continuation-in-part of application No. 08/438,939, May 10, 1995, Pat. No. 5,691,291, which is a continuation-in-part of application No. 08/330,633, Oct. 28, 1994, abandoned.

[51] Int. Cl.[6] ..... C11D 1/75; C11D 1/40

[52] U.S. Cl. ..... 510/214; 510/244; 510/433; 510/499; 510/503

[58] Field of Search ..... 510/214, 244, 510/433, 499, 503

[56] References Cited

U.S. PATENT DOCUMENTS

| | | | |
|---|---|---|---|
| 3,943,234 | 3/1976 | Roggerkamp | 424/343 |
| 4,065,409 | 12/1977 | Flanagan | 252/528 |
| 4,165,334 | 8/1979 | Gosselink et al. | 260/458 |
| 4,252,665 | 2/1981 | Casey et al. | 252/106 |
| 4,276,205 | 6/1981 | Ferry | 252/528 |
| 4,391,726 | 7/1983 | Koster | 252/99 |
| 4,397,776 | 8/1983 | Ward | 252/527 |
| 4,606,850 | 8/1986 | Malik | 252/528 |
| 4,690,779 | 9/1987 | Baker et al. | 252/546 |
| 4,820,436 | 4/1989 | Andree et al. | 252/544 |
| 5,330,674 | 7/1994 | Urfer | 252/176 |
| 5,376,310 | 12/1994 | Cripe et al. | 252/548 |
| 5,378,409 | 1/1995 | Ofosu-Asante | 252/548 |
| 5,389,306 | 2/1995 | Wierenga et al. | 252/547 |
| 5,399,296 | 3/1995 | Wierenga et al. | 252/547 |
| 5,435,935 | 7/1995 | Kupneski | 252/156 |
| 5,476,615 | 12/1995 | Hall et al. | 252/547 |
| 5,486,315 | 1/1996 | Tseng | 510/214 |
| 5,691,291 | 11/1997 | Wierenga et al. | 510/214 |
| 5,703,036 | 12/1997 | Iakovides | 510/503 |

FOREIGN PATENT DOCUMENTS

| | | | |
|---|---|---|---|
| 0 255 978 | 2/1988 | European Pat. Off. | C11D 3/40 |
| 2 123 847 | 2/1984 | United Kingdom | C11D 1/83 |
| 06157 | 4/1992 | WIPO . | |

OTHER PUBLICATIONS

Herbert A. Laitinen and Walter E. Harris, Chemical Analysis, McGraw–Hill Inc., 1975, pp. 27–53.

*Primary Examiner*—Jerry D. Johnson

*Attorney, Agent, or Firm*—Karen F. Clark; Daniel F. Nesbitt; Jacobus C. Rasser

[57] ABSTRACT

Hard surface cleaning compositions which cause little or no vinyl staining comprise from about 1% to about 60% of an amine oxide detergent surfactant having the formula $R^1R^2R^3NO$, wherein $R^1$ has from about 8 to about 30 carbon atoms, and $R^2$ and $R^3$ each individually has from about 1 to about 18 carbon atoms; an aqueous carrier liquid; an amine; and no more than about 2% anionic surfactant. At least a portion of the amine is protonated, and the molar ratio of protonated amine to amine oxide is at least 0.1:1.

18 Claims, No Drawings

COMPOSITIONS AND METHODS FOR CLEANING HARD SURFACES USING PROTONATED AMINES AND AMINE OXIDE SURFACTANTS

CROSS REFERENCE TO RELATED APPLICATIONS

This is a continuation-in-part of U.S. patent application Ser. No. 08/438,939, filed May 10, 1995 now U.S. Pat. No. 5,691,291; which is a continuation-in-part of U.S. patent application Ser. No. 08/330,633, filed Oct. 28, 1994 now abandoned.

TECHNICAL FIELD

The present invention relates to hard surface cleaners. More specifically, the present invention relates to mildly acidic to alkaline hard surface cleaners which comprise an amine oxide detergent surfactant and a protonated amine.

BACKGROUND ART

The use of amine oxide detergent surfactants in cleaning compositions is well known. Amine oxides are most commonly used as cosurfactants to boost and maintain suds formation in laundry, shampoo, and dishwashing detergent compositions. Amine oxides have occasionally been used in hard surface cleaners such as acidic toilet bowl cleaners (pH of 2 or less), dishwashing liquids containing occlusive emollients (pH of 4 to 6.9), and selected non-acidic (neutral to alkaline) hard surface cleaners. In conventional non-acidic hard surface cleaners, amine oxide detergent surfactants are generally non-ionic ($pK_a$ between about 4 and about 6).

Amine oxide detergent surfactants have been used in compositions which also comprise amine buffering agents. Cripe et al., U.S. Pat. No. 5,376,310, and Ofosu-Asante, U.S. Pat. No. 5,378,409, both disclose alkyl ethoxy carboxylate-containing dishwashing compositions which may comprise amine oxide suds boosters and amine buffering agents; both references teach that the $pK_a$ of the buffering agent is about 0.5 to about 1.0 units below the pH of the composition. Fu, WO 92/06157, discloses detergent compositions comprising an alkyl ethoxy carboxylate component and a polyhydroxy fatty acid amide component, which compositions may further comprise amine oxide suds boosters and amine buffering agents. Kokx et al., GB 2,123,847, disclose detergent compositions containing amine oxide which have a reserve alkalinity of greater than about 2.5; Kokx et al. also teach that the compositions preferably contain free monoethanolamine to provide the reserve alkalinity. None of these references teach that the amine is protonated.

These nonionic amine oxides provide good cleaning properties and leave little or no visible residue on hard surfaces when they dry. Unfortunately, non-acidic hard surface cleaners containing amine oxides typically stain or discolor vinyl (e.g., polyvinyl chloride) surfaces. The staining amounts to a light yellow to dark brown discoloration of the vinyl. Staining will also occur on waxed vinyl surfaces where areas of wax are worn thin or are chipped away so that the amine oxide can come in direct contact with the vinyl.

Thus, many prior art non-acidic amine oxide compositions are limited in that the compositions stain vinyl surfaces. Additionally, many prior art amine oxide compositions are limited in that they also contain high levels of anionic compounds or salts thereof, such compositions can leave behind residues and therefore are undesirable for no-rinse applications. Also high level of anionic compounds can cause quaternary disinfectants to precipitate.

SUMMARY OF THE INVENTION

It is an object of this invention to obviate various problems of the prior art.

It is another object of the present invention to provide hard surface cleaning compositions comprising an amine oxide detergent surfactant which causes minimal or no staining of vinyl.

It is also an object of the present invention to provide hard surface cleaning compositions which will have superior cleaning properties and will not leave a visible residue on cleaned surfaces.

It is also an object of the present invention to provide a method for cleaning vinyl surfaces using such compositions.

In accordance with one aspect, the present invention is directed to a hard surface cleaning composition comprising: a) from about 1% to about 60% of an amine oxide detergent surfactant having the formula $R^1R^2R^3NO$, wherein $R^1$ has from about 8 to about 30 carbon atoms, and $R^2$ and $R^3$ each individually have from about 1 to about 18 carbon atoms, b) an amine, and c) no more than about 2% anionic surfactant. At least a portion of the amine is protonated, and the molar ratio of protonated amine to amine oxide is at least 0.1:1.

In accordance with another aspect, the present invention is directed to a concentrated hard surface cleaning composition formed by mixing: a) from about 1% to about 60% of an amine oxide detergent surfactant having the formula $R^1R^2R^3NO$, wherein $R^1$ has from about 8 to about 30 carbon atoms, and $R^2$ and $R^3$ each individually has from about 1 to about 18 carbon atoms, b) an amine, c) an acid, and d) no more than about 2% anionic surfactant. The acid is present at a level sufficient to protonate at least a portion of the amine, and the resulting protonated amine is present in the composition at a molar ratio of protonated amine to amine oxide of at least 0.1:1. The composition has a pH of from about 7 to about 14. The cleaning composition is in a concentrated form and can be diluted with water, if desired, at a ratio of concentrated cleaning composition to water of from about 1:1 to about 1:600 by volume.

In accordance with another aspect, the present invention is directed to a method of reducing vinyl staining during floor cleaning comprising the step of washing the floor with a no-rinse cleaning composition comprising a) from about 0.01% to about 0.3% of an amine oxide detergent; b) an amine; and c) a suds suppressor. At least a portion of the amine is protonated, and the molar ratio of protonated amine to amine oxide in the composition is at least 0.1:1. The composition has a pH of from about 5 to about 14.

These and additional objects and advantages of the present invention will be more fully apparent in view of the following detailed description.

DETAILED DESCRIPTION

Vinyl staining results from dehydrochlorination of polyvinyl chloride. Without being bound by theory, it is believed that this dehydrochlorination reaction is accelerated by nonacidic amine oxide compositions. This accelerated dehydrochlorination is represented by the following reaction formula:

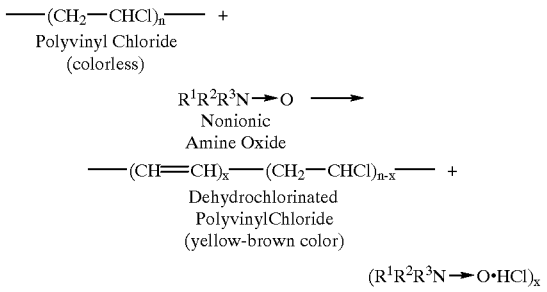

Dehydrochlorinated polyvinyl chloride has a yellow to brown appearance, depending on the degree of double bond (—CH=CH—) formation.

It has been discovered that if the amine oxide is protonated before it comes in contact with the polyvinyl chloride, the rate of the dehydrochlorination reaction will be reduced. Consequently, vinyl staining is significantly reduced or eliminated. The protonation of nonionic to cationic amine oxide is generally represented by the reaction equation:

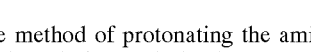

One method of protonating the amine oxide is by acidifying the solution such that between 90% and 100% of the amine oxide within the liquid composition is protonated. (See, for example, co-pending U.S. patent application Ser. No. 08/115,294, filed Sep. 1, 1993; incorporated herein by reference). Since the amine oxides typically have $pK_a$'s of from about 4 to about 6, this approach requires an acidic formulation.

However, in certain instances, a relatively less acidic to basic formulation (e.g., pH of 5 to 12) is desired. It has been discovered that less acidic to basic solutions can be formulated to obtain the advantages of more acidic, protonated amine oxide-containing formulations. In this alternative approach, the amine oxide is essentially "protonated" by ion pairing it with a protonated amine. By hydrogen bonding a protonated amine with the amine oxide, the rate of dehydrochlorination is greatly reduced and vinyl staining is thereby reduced or eliminated. The protonated amine acts as a weak acid in that the protonated amine shares a proton (hydrogen ion) with the amine oxide by forming an ion pair with the amine oxide. Without being bound by theory, the species believed to be formed is as follows:

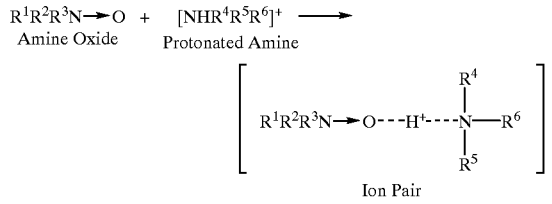

These ion pairs are much less reactive in dehydrochlorination reactions and do not penetrate vinyl surfaces as readily as non-ionic amine oxide species. Furthermore, formation of such ion pairs does not require an acidic formulation. Preferably at least about 10%, more preferably from about 50% to about 100%, more preferably still from about 90% to about 100%, and most preferably 100%, by weight, of the amine oxide in the concentrated composition is present in the form of an ion pair with protonated amine. The concentrated composition of the present invention generally has a pH of from about 5 to about 14, preferably from about 7 to 14, more preferably from about 7 to about 12, even more preferably from about 7 to about 10, and most preferably from about 8 to about 10.

The concentrated liquid and non-liquid compositions can be diluted with an aqueous carrier liquid, preferably water, at a concentrated composition to aqueous carrier liquid ratio of from about 1:1 to about 1:600, preferably from about 1:10 to about 1:600, more preferably from about 1:20 to about 1:300, and most preferably about 1:30 to about 1:260, by volume or weight. The diluted composition generally has a pH of from about 5 to about 14, preferably from about 7 to about 14, more preferably from about 7 to about 12, and most preferably from about 7 to about 10 The diluted composition comprises from about 0.01% to about 0.3%, preferably from about 0.02% to about 0.2%, and most preferably from about 0.04% to about 0.1%, by weight, amine oxide detergent surfactant. Preferably at least about 10%, more preferably from about 50% to about 100%, more preferably still from about 90% to about 100%; most preferably 100% of the amine oxide species in the diluted composition is ion paired with a protonated amine.

As used herein "liquid compositions" is intended to include mildly acidic to alkaline, i.e. pH of from about 5 to about 14, concentrated liquid hard surface cleaning compositions of the present invention, or aqueous dilutions thereof.

As used herein "non-liquid" is intended to include granular, powder or gel formulations which can be diluted with the aqueous carrier liquid described hereinafter to produce the hard surface cleaning composition.

As used herein "vinyl" is intended to include material or surfaces containing polyvinyl chloride ("PVC"). Such material or surfaces can be waxed or unwaxed.

All pH values herein are measured in aqueous systems at 25° C. (77° F.). The compositions of the present invention generally have a pH of from about 5 to about 14, preferably from about 7 to about 14, more preferably from about 7 to about 12, most preferably from about 7 to about 10.

All percentages are by weight of total composition unless specifically stated otherwise. All ratios are weight ratios unless specifically stated otherwise. All formula components are assumed to be 100% active unless otherwise noted.

The present invention is described in detail as follows.

Amine Oxide Detergent Surfactant

The concentrated composition generally comprises from about 1% to about 60%, preferably from about 2% to about 50%, more preferably from about 1% to about 30%, even more preferably from about 1% to 25%, and most preferably 1–20% by weight of the composition, of an amine oxide detergent surfactant. Commercially available amine oxides are typically aqueous formulations containing from about 20% to 40%, by weight, amine oxide. The activity of such amine oxide stock solutions refers to the concentration of amine oxide, i.e., a stock solution referred to as "30% active" comprises about 30% amine oxide. One of ordinary skill in the art will appreciate that the amount of amine oxide stock solution required to obtain a chosen level of amine oxide will vary depending upon the activity of the amine oxide stock solution used.

Solid amine oxides are preferred for use in solid or granular detergent formulations. Methods for preparing amine oxides in dry formulation include forming an aqueous solution of an amine oxide salt and an organic sulfonic acid or a fatty alcohol half-ester of sulfuric acid, and extracting the resulting salt with a water-immiscible organic solvent; preparing an amine oxide formulation wherein at least some of the amine oxide is in dihydrate form; or forming a precipitate by admixing maleic acid with an aqueous amine oxide solution, and separating out the precipitate. See, for example, Wierenga et al., U.S. Pat. Nos. 5,389,306 and 5,399,296.

The amine oxide preferably has the formula $R^1R^2R^3NO$, where $R^1$ is a substituted or unsubstituted alkyl or alkene group containing from about 8 to about 30 carbon atoms, preferably from about 8 to about 18 carbon atoms, and $R^2$ and $R^3$ are each substituted or unsubstituted alkyl or alkene groups containing from about 1 to about 18 carbon atoms, preferably from about 1 to about 4 carbon atoms. More preferably, $R^2$ and $R^3$ are each methyl groups; examples of such amine oxides include dodecyldimethyl amine oxides, tetradecyldimethyl amine oxides, hexadecyldimethyl amine oxides, octadecyldimethyl amine oxides, and coconutalkyl dimethyl amine oxides.

The amine oxide detergent surfactant can be prepared by known and conventional methods. One such method involves the oxidation of tertiary amines in the manner set forth in U.S. Pat. No. 3,223,647 and British Patent 43,566. In general terms, amine oxides are prepared by the controlled oxidation of the corresponding tertiary amines.

Examples of suitable amine oxide detergent surfactants for use in the hard surface cleaning composition include:

dodecyldimethyl amine oxide
tridecyldimethyl amine oxide
tetradecyldimethyl amine oxide
pentadecyldimethyl amine oxide
hexadecyldimethyl amine oxide
heptadecyldimethyl amine oxide
octadecyldimethyl amine oxide
dodecyldiethyl amine oxide
tetradecyldiethyl amine oxide
hexadecyldiethyl amine oxide
octadecyldiethyl amine oxide
dodecyldipropyl amine oxide
tetradecyldipropyl amine oxide
hexadecyldipropyl amine oxide
octadecyldipropyl amine oxide
dodecyldibutyl amine oxide
tetradecyldibutyl amine oxide
hexadecyldibutyl amine oxide
octadecyldibutyl amine oxide
dodecylmethylethyl amine oxide
tetradecylmethylethyl amine oxide
tetradecylethylpropyl amine oxide
hexadecylpropylbutyl amine oxide
octadecylmethylbutyl amine oxide Also useful are the amine oxide detergent surfactants which are prepared by the oxidation of tertiary amines prepared from mixed alcohols obtainable from coconut oil. Coconutalkyl amine oxides are preferred inasmuch as it is not necessary for the present purposes to separate the mixed alcohol fractions into their pure components to secure the pure chain length fractions of the amine oxides.

Protonated Amine

Any amine capable of being protonated is useful in the composition. Preferably the amine is a protonated primary, secondary or tertiary amine. Preferred are ammonium hydroxide and protonated monoethanolamine.

Generally, a sufficient quantity of protonated amine is included in the composition to obtain a molar ratio ("target molar ratio") of protonated amine to amine oxide of at least about 0.1:1. Preferably the molar ratio ranges from about 0.1:1 to about 2:1, more preferably from about 0.5:1 to about 1.5:1, even more preferably from about 0.8:1 to about 1.2:1; most preferably the molar ratio is about 1:1. Achieving the target molar ratio of at least 0.1:1 is important for minimizing or eliminating the staining of vinyl.

Amines are generally chosen based on the desired pH of the composition. Generally the composition has a pH of from about 5 to about 14, preferably from about 7 to about 14, more preferably from about 7 to about 12, more preferably from about 7 to about 10. Generally the amine will have a $pK_a$ above the desired pH of the composition. Preferably the $pK_a$ of the amine is about 0.5 units, more preferably about 1.0 units, and most preferably about 1.5 units, above the pH of the composition. A $pK_a$ about 1.5 units above the desired pH of the composition will minimize the amount of amine necessary to achieve the target molar ratio of protonated amine to amine oxide, since essentially all of the amine will be protonated under such conditions. An amine having a $pK_a$ less than about 1.5 units greater than the pH of the composition may be used, or a composition pH can be selected which is greater than 1.5 units below the $pK_a$ of the amine used, however, as the degree of protonation of the amine decreases as the pH of the composition is increased above about 1.5 units below the $pK_a$ of the amine, relatively more of the amine will be required to achieve the target molar ratio of protonated amine to amine oxide.

The following non-limiting discussion illustrates one method for the calculation of the level of a selected protonated amine used to maintain a 1:1 molar ratio with a selected amine oxide. If the desired formula pH is 8.0, then the amine should preferably have a $pK_a$ of about 9.5. However, amines with lower $pK_a$'s can be used as long as the concentration of protonated amine is adjusted to maintain the 1:1 molar ratio. For example, monoethanolamine ("MEA") has a $pK_a$ of 9.44, as set forth in *Biochemical Calculations* 2nd ed, I. H. Segal, John Wiley & Sons, Inc., 1976, p. 406. Therefore, at pH 8.0 it is 96% protonated. The percent of protonated monoethanolamine can be calculated using the following equation wherein $\alpha_{MEA\text{-}H+}$ represents the fraction of protonated monoethanolamine.

$$\alpha_{MEA\text{-}H+}=[H^+]/(Ka+[H^+])$$

$$\alpha_{MEA\text{-}H+}=(10^{-8})/(10^{-9.44}+10^{-8})=0.96 \text{ or } 96\% \text{ protonated at pH } 8.0$$

A formula containing 9% lauryldimethylamine oxide (MW of 229) would need 2.5% MEA (MW of 61) to maintain a 1:1 molar ratio between MEA-$H^+$ and laurylmethylamine oxide at pH 8.0:

$$(9\% \text{ amine oxide}/229)\bullet(61)/(0.96)=2.5\% \text{ MEA}$$

MEA can be used in a more alkaline formula to prevent staining as long as the concentration of MEA is increased to maintain the 1:1 molar ratio of protonated amine to amine oxide. For example, at a formula pH of 9.0, the MEA level of the composition must be increased to 3.28% to prevent vinyl staining:

$$\alpha\text{MEA-H+}=(10^{-9})/(10^{-9.44}+10^{-9})=0.73 \text{ or } 73\% \text{ protonated at pH } 9.0\ (9\% \text{ amine oxide}/229)\bullet(61)/(0.73)=3.28\% \text{ MEA.}$$

As indicated by the equation:

$$\alpha_{MEA\text{-}H+}=[H^+]/(K_a+[H^\times])$$

the $pK_a$ of MEA and the concentration of hydrogen ion can be used to calculate the degree of protonation of MEA at a given pH. A more general form of the equation is:

$$\alpha_{HA}=[H^+]/(K_a+[H^+]) \quad (1)$$

wherein a HA represents the fraction of protonated amine, $[H^+]$ represents the hydrogen ion concentration, and $K_a$ is the dissociation constant of the amine.

According to the Bronsted definition, an acid is a substance that can donate a proton (hydrogen ion), while a base is a substance that can accept a proton. For example, base B can accept a proton to form the conjugate acid HB as represented by the equation:

$$B+H_2O \leftrightarrows HB+OH^{-1}.$$

An amine, such as monoethanolamine, can act as a base according to the equation:

$$RNH_2+H_2O \leftrightarrows RNH_3^{+}+OH^{-}.$$

In such a reaction the amine is acting as a proton acceptor.

However, the conjugated acid of an amine, the protonated amine, is a proton donor and acts as a weak acid. Generally when an acid, HA, is added to water, it dissociates, as represented by the equation:

$$HA \leftrightarrows H^{+}+A^{-}. \quad (2)$$

In the case of protonated amines, HA represents the protonated amine and $A^-$ represents the unprotonated amine. The dissociation of a protonated amine can be represented according to the equation:

$$RNH_3^{+} \leftrightarrows H^{+}+RNH_2.$$

The dissociation constant of the acid, $K_a$, can be written as $$K_a=[H^+][A^-]/[HA]; \quad (3)$$

therefore, $$[HA]=[H^+][A^-]/K_a. \quad (4)$$

Only strong mineral acids, such as sulfuric, hydrochloric, and nitric acids, or strong bases such as sodium hydroxide, dissociate completely in water. The majority of acids and bases are partially dissociated in water, so the total concentration of acid (or base) added to solution is the sum of the dissociated and the undissociated species. The total acid in a solution can be represented by the equation:

$$C_{HA}=[HA]+[A^-]$$

where [HA] represents the concentration of undissociated acid, $[A^-]$ represents the concentration of dissociated acid, and CHA represents the concentration of the sum of both species in solution.

Similarly, when a protonated amine is acting as an acid, the total concentration of amine is the sum of the unprotonated and the protonated species. Therefore, the total can be represented by the equation:

$$C_{HA}=[HA]+[A^-] \quad (5)$$

where [HA] represents the concentration of undissociated acid (protonated amine, or $RNH_3^+$), $[A^-]$ represents the concentration of dissociated acid (unprotonated amine, or $RNH_2$), and CHA represents the concentration of the sum of both species of amine in solution.

The fraction of undissociated acid (protonated amine) in solution, $\alpha_{HA}$, can be defined as:

$$\alpha_{HA}=[HA]/C_{HA}=[HA]/[HA]+[A^-]; \quad (6)$$

similarly, the fraction of dissociated acid (unprotonated amine) in solution, $\alpha_{A^-}$, can be defined as:

$$\alpha_{A^-}=[A^-]/C_{HA}=[A^-]/[HA]+[A^-]. \quad (7)$$

Substituting $\{[H^+][A^-]\}/K_a$ of equation (4) for [HA] in equation (6) gives:

$$\alpha_{HA} = \frac{\{[H^+][A^-]\}/K_a}{\{[H^+][A^-]/K_a\}+[A^-]} \quad (8)$$

$$\alpha_{HA} = \frac{\{[H^+][A^-]\}/K_a}{\{[H^+][A^-]+K_a[A^-]\}/K_a} \quad (9)$$

$$\alpha_{HA} = \frac{[H^+][A^-]}{\{[H^+][A^-]+K_a[A^-]\}} \quad (10)$$

$$\alpha_{HA} = \left\{\frac{[H^+][A^-]}{[A^-]\{[H^+]+K_a\}}\right. \quad (11)$$

$$\alpha_{HA} = \frac{[H^+]}{[H^+]K_a}. \quad (12)$$

Therefore, the fraction of undissociated acid (unprotonated amine) at any pH can be defined by equation (1). Further discussion of acid-base equilibria can be found in the chapter entitled Acid-Base Equilibria in Water from the text *Chemical Analysis* 2nd ed, H. A. Laitinen and W. E. Harris, McGraw-Hill, Inc., 1975.

Preferably the amine has a $pK_a$ of from about 6.5 to about 14, more preferably from about 7.5 to about 10.5. Values for $pK_a$ of various amines can be found in literature references such as *Biochemical Calculations 2nd ed,* I. H. Segal, John Wiley & Sons, Inc., 1976; *CRC Handbook of Chemistry and Physics 62th ed,* The Chemical Rubber Company, 1981; and *The Merck Index 11th ed,* Merck & Co., 1989. Additionally, one of ordinary skill will appreciate that the $pK_a$ of a compound can be calculated through titration. Examples of such calculations are set forth in references such as *Chemical Analysis 2nd ed,* H. A. Laitinen and W. E. Harris, McGraw-Hill, Inc., 1975, Chapter 3, pages 27–53, incorporated herein by reference.

An acid can serve as a proton source for the protonation of the amine; preferably the acid will be a strong mineral acid. Suitable mineral acids include hydrochloric, phosphoric, perchloric and nitric acids; preferred acids include hydrochloric acid, phosphoric acid and mixtures thereof. The acid is present at a level sufficient to protonate at least a portion of the amine, such that the resulting protonated amine is present in the composition at a molar ratio of protonated amine to amine oxide of at least about 0.1:1. The concentrated composition generally contains from about 1% to about 10%, preferably from about 1% to about 7%, more preferably from about 1% to about 6% of acid; preferably the acid is phosphoric acid, hydrochloric acid, or mixtures thereof Aqueous Carrier Liquid The compositions herein are employed on hard surfaces in liquid form. Accordingly, the foregoing components are admixed with an aqueous carrier liquid. Appropriate aqueous carrier liquids are safe and chemically compatible with the components of the compositions. Compositions used for cleaning waxed floors preferably comprise carriers which do not strip wax, and are preferably free of compounds which do strip wax.

The aqueous carrier liquid can comprise solvents commonly used in hard surface cleaning compositions. Suitable solvents are compatible with the components of the composition and are chemically stable at the desired pH of the composition. They should also have good filming/residue properties. Solvents for use in hard surface cleaners are described, for example, in U.S. Pat. No. 5,108,660.

Preferably, the aqueous carrier liquid is water or a miscible mixture of alcohol and water. Water-alcohol mixtures containing from about 0% to 50% alcohol are preferred as the alcohol can aid in the dispersion and dissolution of the amine oxide and other materials in the compositions. The alcohols are preferably $C_2$–$C_4$ alcohols; ethanol is most preferred.

Most preferably, the aqueous carrier liquid is water or a water-ethanol mixture containing from about 0% to about 50% ethanol. From about 40% to about 98.9% aqueous liquid carrier is used.

Non-liquid Formulation

The present invention also embodies a non-liquid composition from which the liquid hard surface cleaning compositions can easily be obtained by adding an aqueous carrier liquid. The non-liquid composition can be in granular, powder or gel form; the granular form is preferred.

The non-liquid composition comprises sufficient protonated amine to provide, upon dilution with the aqueous carrier liquid, a ratio of protonated amine to amine oxide within the ranges described herein for the liquid compositions. The diluted composition has a pH of from about 5 to about 14, preferably from about 7 to about 14, more preferably from about 7 to about 12, most preferably from about 7 to about 10. The diluted composition comprises from about 0.01% to about 0.3%, preferably from about 0.02% to about 0.2%, and more preferably from about 0.04% to about 0.1%, by weight, amine oxide detergent surfactant. Preferably at least about 10%, more preferably from about 50% to about 100%, more preferably still from about 90% to about 100%; most preferably 100% of the amine oxide species in the diluted composition is ion paired with a protonated amine.

The non-liquid gel composition contains reduced amounts of the non-aqueous carrier liquid. The non-liquid granular composition contains substantially no aqueous carrier liquid. In either form, an aqueous carrier liquid is added to the non-liquid composition prior to use to form the liquid hard surface cleaning composition. The non-liquid composition can be diluted with an aqueous carrier liquid, preferably water, at a concentrated composition to aqueous carrier liquid ratio of from about 1:1 to about 1:600, preferably from about 1:10 to about 1:600, more preferably from about 1:20 to about 1:300, and most preferably about 1:30 to about 1:260, by volume or weight.

Auxiliary Materials

Optionally, the compositions herein can contain auxiliary materials which augment cleaning and aesthetics.

The compositions can optionally comprise a non-interfering auxiliary surfactant in addition to the amine oxide detergent surfactant. Additional auxiliary surfactants can effect cleaning activity. The choice of auxiliary surfactant depends on the intended purpose of the compositions and the commercial availability of the surfactant. A wide variety of organic, water soluble surfactants can optionally be employed, such as any of the anionic, nonionic and zwitterionic/amphoteric surfactants commonly employed in liquid hard surface cleaning compositions.

Suitable surfactants which can be employed in the compositions herein include anionic surfactants such as the alkyl sulfates, alkyl benzene sulfonates, olefin sulfonates, fatty acyl isethionates and taurides, allyl sulfoccinates, alkyl ether sulfates ($AE_2SO_4$) and many others. The term "alkyl" used to describe these various surfactants encompasses the hydrocarbyl alkyl groups having a chain length of from about $C_8$ to $C_{22}$, i.e., materials of the type generally recognized for use as detergents.

The anionic surfactants can be in the form of their water soluble salts, for example, the amine, ammonium, alkanolammonium or alkali metal salts. However, salts of anionic compounds can leave behind a residue when dried. Therefore, if a residue-free no-rinse composition is desired, anionic surfactants should be present at a level which will leave behind no visible residue; generally the anionic surfactants should be present at a level of no more than about 2%, preferably no more than about 1%, and more preferably about 0%, by weight of the composition.

For most purposes it is preferred to use the anionic materials in their acid form to reduce the amount of auxiliary acid needed to acidify the composition. Especially preferred anionic surfactants herein are alkyl benzene sulfates and sulfonates; the alkyl ether sulfates of the general formula AExSO4 wherein A is a $C_{10}$–$C_{22}$ alkyl, E is ethylene oxide, and wherein x is an integer from 0 to 30; the $C_{10}$–$C_{14}$ olefin sulfonates; and mixtures thereof.

Examples of suitable nonionic surfactants include the polyethoxysorbitan esters, fatty acyl mono- and di-ethanol amides, $C_8$–$C_{22}$ ethoxylates and mixed coconut ethoxylates containing 1 to 30 ethoxylate groups.

Examples of suitable zwitterionic surfactants include the fatty alkyl betaines and sulfobetaines and similar compounds such as $C_8$ to $C_{18}$ ammonio propane sulfonate and $C_8$ to $C_{18}$ hydroxy ammonio propane sulfonates.

In one preferred embodiment, the compositions are used to clean waxed floors. Compositions which are used to clean waxed floors are preferably substantially free of compounds which tend to strip, i.e. remove, wax from waxed floors. Compounds having such a detrimental effect on floor wax include ammonium alkyl ethoxylated sulfate surfactants, ammonium alkyl surfactants, and glycol ethers, such as mono- and dialkyl ethers of ethylene glycol and diethylene glycol, commonly referred to as cellosolves and carbitols. Concentrated compositions used for cleaning waxed floors will preferably have less than 5%, more preferably less than 1%, even more preferably less than 0.5%, and most preferably 0%, by weight, of compounds which are capable of stripping wax from floors.

Optionally, and preferably, the compositions contain water miscible substances having disinfectant properties. Preferred disinfectants are quaternary ammonium compounds, which are well known in the detergency art. Examples of suitable quaternary ammonium disinfectants include didecyl dimethyl ammonium chloride, N-alkyl ($C_{12}$ to $C_{18}$) dimethyl ammonium chloride, and N-alkyl ($C_{12}$ to $C_{18}$) dimethyl ethyl benzyl ammonium chloride.

Detergent builders can be employed in the compositions. These builders are especially useful when auxiliary surfactants or cosurfactants are employed, and are even more useful when the compositions are diluted prior to use with exceptionally hard tap water, e.g., above about 12 grains per gallon. Detergent builders sequester calcium and magnesium hardness ions that might otherwise bind with and render less effective the auxiliary surfactants or cosurfactants. Preferably the composition contains no added magnesium ions, as these can leave behind a residue when dried.

The detergent builders can be employed in the compositions at concentrations of between about 0% and about 10%, by weight of the composition. Anionic builders can leave behind residue when dried. Therefore, if a residue-free no-rinse composition is desired, anionic builders should be present at a level which will leave behind no visible residue; preferably anionic builders are present at a level of no more than about 2%, more preferably no more than about 1%, and most preferably about 0%, by weight of the composition.

Suds suppressors are especially useful in the composition. In the hard surface cleaning composition herein, suds formation and maintenance are undesirably promoted by the amine oxide component. The compositions therefore preferably comprise a sufficient amount of a suds suppressor to prevent excessive sudsing during employment of the compositions on hard surfaces. Suds suppressors are especially useful to allow for no-rinse application of the composition.

The suds suppressors can be provided by known and conventional means. Selection of a suds suppressor depends on its ability to formulate in the compositions, and the residue and cleaning profile of the compositions. Suitable suds suppressors are chemically compatible with the components in the compositions, and functional at the pH range described herein, and do not leave a visible residue on cleaned surfaces.

Low-foaming cosurfactants can be used as suds suppressor to mediate the suds profile in the compositions. Cosurfactant concentrations between about 0.1% and about 3%, by weight of the composition, are normally sufficient. Examples of suitable cosurfactants for use herein include block copolymers (e.g., Pluronic® and Tetronic®, both available from BASF Company) and alkoxylated (e.g., ethoxylated/propoxylated) primary and secondary alcohols (e.g., Tergitol®, available from Union Carbide; Poly-Tergent®, available from Olin Corporation).

The optional suds suppressor preferably comprises a silicone-based material. These materials are effective as suds suppressors at very low concentrations. The compositions preferably comprise from about 0.01% to about 0.50%, more preferably from about 0.01% to about 0.3%, by weight of the composition, of the silicone-based suds suppressor. At these low concentrations, the silicone-based suds suppressor is less likely to interfere with the cleaning performance of the compositions. Examples of suitable silicone-based suds suppressors for use in the compositions include Dow Corning® AF-2210 and Dow Corning® AF-GPC, both available from Dow Corning Corporation.

These optional but preferred silicone-based suds suppressors can be incorporated into the composition by known and conventional means. Such materials are typically water insoluble and require suspension in the aqueous environment of the compositions. The silicone-based suds suppressors are typically suspended by either increasing the viscosity of the liquid compositions or by matching the specific gravity of the compositions with that of the silicone-based suds suppressor.

Other optional additives such as perfumes, brighteners, enzymes, colorants, and the like can be employed in the compositions to enhance aesthetics and/or cleaning performance. Suitable additives are compatible with the active components in the composition, and do not interfere with the inhibition of vinyl staining provided by the compositions.

Methods of Use

The invention also encompasses methods for cleaning waxed and unwaxed vinyl surfaces, and methods on reducing vinyl staining during floor cleaning. One method comprises applying to a vinyl surface the mildly acidic to alkaline cleaning compositions herein or, preferably, applying an aqueous dilution thereof. The vinyl surface is then wiped with a porous material, e.g., cloth or mop, and allowed to dry. Another method, which is preferred for cleaning large floor surfaces, uses an automatic scrubber. Such automatic scrubbers are commercially available, and automatically apply the cleaning composition, scrub the floor, and squeegee and remove used cleaning composition.

In one preferred method, the liquid composition is first diluted with an aqueous liquid, preferably tap water. The diluted composition has a pH of from about 5 to about 14, preferably from about 7 to about 14, more preferably of from about 7 to about 12, most preferably from about 7 to about 10. The diluted composition comprises from about 0.01% to about 0.3%, preferably from about 0.02% to about 0.2%, more preferably from about 0.04% to about 0.1%, by weight of the composition, amine oxide detergent surfactant. Preferably, at least about 10% of the amine oxide species in the diluted composition is ion paired with a protonated amine, more preferably from about 50% to about 100%, more preferably still from about 90% to about 100%; most preferably 100%. The diluted composition is then applied to and wiped over the vinyl surface using a porous material and allowed to dry; alternatively, the diluted composition is applied to the vinyl surface using an automatic scrubber.

In another preferred method, vinyl floors are cleaned with a composition comprising from about 0.01% to about 0.3% of an amine oxide detergent; an amine; and a suds suppressor. At least a portion of the amine is protonated, and the molar ratio of protonated amine to amine oxide in the composition is at least 0.1:1. The composition has a pH of from about 5 to about 14.

EXAMPLES

The following examples further describe and demonstrate preferred embodiments within the scope of the present invention. The examples are intended only to further illustrate the invention and are not intended to limit the scope of the invention which is defined in the claims.

Example 1

This example sets forth the preparation and use of a hard surface cleaning composition. The following components are combined to form a composition having a pH of about 8.0:

| COMPONENT | % BY WEIGHT |
|---|---|
| Coconut dimethyl amine oxide | 18.0 |
| Monoethanolamine | 5 |
| Dow Corning AF-GPC | 0.2 |
| Phosphoric acid | 2.4 |
| Hydrochloric acid | 1.6 |
| Dye/perfume | 0.16 |
| Water | q.s. to 100% |

The composition comprises 18% of coconut dimethyl amine oxide; this amine oxide level can be obtained by adding, for example, about 58%, by weight of the composition, of a stock solution of 31% coconut dimethylamine oxide. The above composition is diluted 1:256 with water. Soiled vinyl tiling is cleaned with the diluted composition by wiping a mop soaked with the diluted composition across the surface of the vinyl tiling. The vinyl tiling is allowed to air dry. The composition provides excellent cleaning benefits and shine maintenance, and is non-streaking. Furthermore, repeated cleaning of the vinyl tiling with this composition over an extended period of time results in minimal to no staining of the vinyl.

Example 2

This example sets forth the preparation and use of a hard surface cleaning composition. The following components are combined to form a composition having a pH of about 9.0:

| COMPONENT | % BY WEIGHT |
|---|---|
| Coconut dimethyl amine oxide | 9.0 |
| Monoethanolamine | 3.3 |
| Dow Corning AF-GPC | 0.1 |
| Phosphoric acid | 0.0 |
| Hydrochloric acid | 5.4 |
| Dye/perfume | 0.8 |
| Water | q.s. to 100% |

The composition comprises 9% of coconut dimethyl amine oxide; this amine oxide level can be obtained by adding, for example, about 29%, by weight, of a stock solution of 31% coconut dimethylamine oxide. The above composition is diluted 1:128 with water. Soiled vinyl tiling is cleaned with the diluted composition by wiping a mop soaked with the diluted composition across the surface of the vinyl cleaning benefits and shine maintenance, and is non-streaking. Furthermore, repeated cleaning of the vinyl tiling with this composition over an extended period of time results in minimal to no staining of the vinyl.

Example 3

This example sets forth the preparation and use of a hard surface cleaning composition. The following components are combined to form a composition having a pH of about 10.0:

| COMPONENT | % BY WEIGHT |
|---|---|
| Coconut dimethyl amine oxide | 4.5 |
| t-Butyl amine ($pK_a$ = 10.83) | 1.7 |
| Dow Corning AP-GPC | 0.05 |
| Phosphoric acid | 0.0 |
| Hydrochloric acid | 2.5 |
| Dye/perfume | 0.4 |
| Water | q.s. to100% |

The composition comprises 4.5% of coconut dimethyl amine oxide; this amine oxide level can be obtained by adding, for example, about 15%, by weight, of a stock solution of 31% coconut dimethylamine oxide. The above composition is diluted 1:64 with water. Soiled vinyl tiling is cleaned with the diluted composition by wiping a mop soaked with the diluted composition across the surface of the vinyl tiling. The vinyl tiling is allowed to air dry. The composition provides excellent cleaning benefits and shine maintenance, and is non-streaking. Furthermore, repeated cleaning of the vinyl tiling with this composition over an extended period of time results in minimal to no staining of the vinyl.

All publications and patent applications mentioned herein above are hereby incorporated in their entirety by reference.

Having described the preferred embodiments of the present invention, further adaptions of the compositions and methods described herein can be accomplished by appropriate modifications by one of ordinary skill in the art without departing from the scope of the present invention. A number of alternatives and modifications have been described herein, and others will be apparent to those skilled in the art. Accordingly, the scope of the present invention should be considered in terms of the following claims, and is understood not to be limited to the details of the compositions and methods described in the specification.

What is claimed is:

1. A hard surface cleaning composition consisting essentially of:

a) from about 1% to about 60%, by weight, of an amine oxide detergent surfactant having the formula $R^1R^2R^3NO$, wherein $R^1$ is an unsubstituted alkyl or alkene group containing from about 8 to about 30 carbon atoms, and $R^2$ and $R^3$ are each individually unsubstituted alkyl or alkene groups containing from about 1 to about 18 carbon atoms;

b) an amine; and c) no more than about 2% anionic surfactant; and wherein at least a portion of the amine is protonated, and the molar ratio of protonated amine to amine oxide is at least 0.1:1.

2. A cleaning composition according to claim 1, wherein the protonated amine is present in the composition at a molar ratio of protonated amine to amine oxide detergent surfactant is from about 0.1:1 to about 2:1.

3. A cleaning composition according to claim 2, wherein the protonated amine is present in the composition at a molar ratio of protonated amine to amine oxide of about 1:1.

4. A cleaning composition according to claim 1, wherein the amine has a $pK_a$ greater than the pH of the composition.

5. A cleaning composition according to claim 4, wherein the amine has a $pK_a$ of about 0.5 units above the pH of the composition.

6. A cleaning composition according to claim 1, wherein the pH of the composition is from about 5 to about 14.

7. A cleaning composition according to claim 5, wherein the pH of the composition is from about 7 to about 10.

8. A cleaning composition according to claim 1, wherein the amine oxide detergent surfactant has the formula $R^1R^2R^3NO$, where $R^1$ is an unsubstituted alkyl or alkene group containing from about 8 to about 30 carbon atoms, and $R^2$ and $R^3$ are each individually unsubstituted alkyl or alkene groups containing from about 1 to about 4 carbon atoms.

9. A cleaning composition according to claim 8, wherein the composition comprises from about 1% to about 30% of the amine oxide detergent surfactant, and further consists essentially of an aqueous carrier liquid and an acid.

10. A cleaning composition according to claim 1, wherein the composition further consists essentially of a suds suppressor.

11. A cleaning composition according to claim 1, wherein the composition further consists essentially of a quaternary disinfectant.

12. A cleaning composition according to claim 1, wherein the protonated amine is ammonium hydroxide or protonated monoethanolamine.

13. A concentrated hard surface cleaning composition formed by mixing:

a) from about 1% to about 60% of an amine oxide detergent surfactant, having the formula $R^1R^2R^3NO$, wherein $R^1$ is an unsubstituted alkyl or alkene group containing from about 8 to about 30 carbon atoms, and $R^2$ and $R^3$ are each individually unsubstituted alkyl or alkene groups containing from about 1 to about 18 carbon atoms;

b) an amine;

c) an acid; and d) a suds suppresser; and wherein the acid is added at a level sufficient to protonate at least a portion of the amine, and the resulting protonated amine is present in the composition at a molar ratio of protonated amine to amine oxide of at least 0.1:1, and wherein the composition has a pH of from about 5 to about 14.

14. A concentrated cleaning composition according to claim 13 comprising no more than about 2% anionic surfactant.

15. A concentrated cleaning composition according to claim 14 further comprising a quaternary disinfectant.

16. A concentrated cleaning composition according to claim 13 further comprising a quaternary disinfectant.

17. A cleaning composition, comprising the concentrated cleaning composition according to claim 13 diluted with water at a ratio of concentrated cleaning composition to water of from about 1:1 to about 1:600 by volume.

18. A hard surface cleaning composition consisting essentially of:

a) from about 1% to about 60%, by weight, of an amine oxide detergent surfactant selected from the group consisting of dodecyldimethyl amine oxide, tridecyldimethyl amine oxide, tetradecyldimethyl amine oxide, pentadecyldimethyl amine oxide, hexadecyldimethyl amine oxide, heptadecyldimethyl amine oxide, octadecyldimethyl amine oxide, dodecyldiethyl amine oxide, tetradecyldiethyl amine oxide, hexadecyldiethyl amine oxide, octadecyldiethyl amine oxide, dodecyldipropyl amine oxide, tetradecyldipropyl amine oxide, hexadecyldipropyl amine oxide, octadecyldipropyl amine oxide, dodecyldibutyl amine oxide, tetradecyldibutyl amine oxide, hexadecyldibutyl amine oxide, octadecyldibutyl amine oxide, dodecylmethylethyl amine oxide tetradecylmethylethyl amine oxide, tetradecylethylpropyl amine oxide, hexadecylpropylbutyl amine oxide, octadecylmethylbutyl amine oxide, and mixtures thereof, b) an amine; and c) no more than about 2% anionic surfactant;

wherein at least a portion of the amine is protonated, and the molar ratio of protonated amine to amine oxide is at least 0.1:1.

* * * * *